US006241293B1

(12) United States Patent
Hayakawa et al.

(10) Patent No.: US 6,241,293 B1
(45) Date of Patent: Jun. 5, 2001

(54) DOOR LOCK DEVICE FOR VEHICLES

(75) Inventors: Shigeru Hayakawa; Norio Konomoto; Akira Muramatsu, all of Aichi-ken (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/328,792

(22) Filed: Jun. 9, 1999

(30) Foreign Application Priority Data

Jun. 9, 1998 (JP) ..... 10-160057

(51) Int. Cl.[7] ..... E05C 3/06

(52) U.S. Cl. ..... 292/216; 292/DIG. 64; 403/348

(58) Field of Search ..... 292/216, 201, 292/DIG. 23, DIG. 64; 403/348

(56) References Cited

U.S. PATENT DOCUMENTS

| | | | | |
|---|---|---|---|---|
| 3,608,941 | * | 9/1971 | Kondo | 292/216 |
| 3,990,734 | | 11/1976 | Kinser . | |
| 4,102,213 | * | 7/1978 | Smith | 292/201 |
| 4,508,379 | | 4/1985 | Mochida . | |
| 4,832,524 | * | 5/1989 | Olgren | 403/348 |
| 4,885,954 | * | 12/1989 | Wanlass | 292/201 |
| 4,905,532 | * | 3/1990 | Fukumoto | 292/201 |
| 5,015,020 | * | 5/1991 | Mizuki | 292/216 |
| 5,516,167 | * | 5/1996 | Hayakawa | 292/201 |
| 5,800,022 | * | 9/1998 | Del Rosario | 403/348 |

FOREIGN PATENT DOCUMENTS

| | | |
|---|---|---|
| 8-260775 | 10/1996 | (JP) . |
| 10-37559 | 2/1998 | (JP) . |
| 10-131579 | 5/1998 | (JP) . |

* cited by examiner

*Primary Examiner*—B. Dayoan
*Assistant Examiner*—Gary Estremsky
(74) *Attorney, Agent, or Firm*—Burns, Doane, Swecker & Mathis, LLP

(57) ABSTRACT

A door lock device includes a base plate 2 having horizontal wall 21 connected to a door lock body 31 and vertical wall 22 perpendicular to the horizontal wall 21, a rotation lever 49 rotatably supported to the vertical wall 22, a key lever 47 rotatably supported to a housing 64 of an actuator 6 which is secured to the vertical wall 22, and a connecting lever 48 having one end and the other end, one end being coupled to the rotation lever 49 after rotation of one end to the rotation lever 49, the other being coupled to the key lever 47 after rotation of the other end to the key lever 47, the connecting lever 48 being in parallel and close to the connecting vertical wall 22 of the base plate 2.

18 Claims, 9 Drawing Sheets

DOOR LOCK DEVICE FOR VEHICLES

BACKGROUND OF THE INVENTION

1. Field of the Invention

The present invention is directed to a door lock device for vehicles.

2. Brief Description of the Related Art

One of the conventional door lock devices is disclosed in Japanese Patent Laid-open Print No. Hei.10(1998A.D.)-37559 published without examination. This door lock device includes a base plate having a horizontal wall to which a door lock body is connected and a vertical wall which is substantially perpendicular to the horizontal wall, a rotation lever rotatably connected to the vertical wall of the base plate, a key lever rotatably connected to an actuator housing secured to the vertical wall of the base plate, and a connecting link connecting the key lever and the rotation lever, wherein rotating the rotation lever causes a linear movement of the connecting link with the result of a rotation of the key lever.

In the foregoing door lock device, one end of the connecting link is fitted in a hole of the rotation lever so as to establish a connection between the connecting link and the rotation lever, while an operating connection between the connecting link and the key lever is established in such a manner that the other end of the connecting lever is fitted in a hole of an intermediate member connected to the key lever.

However, for establishing the operating connection between the key lever and the connecting link, an intermediate member is required which is in the form of a member separate from the key lever, which results in an increase of the number of parts. Moreover, to ensure the fitting connection between each of the opposite ends of the connecting link and the hole of the corresponding member, a suitable device such as an E-ring is required, thereby causing assembly of the door lock device to be relatively cumbersome.

SUMMARY OF THE INVENTION

In light of the foregoing, a door lock device in accordance with the present invention is free from the foregoing drawbacks.

According to a first exemplary embodiment, a door lock device according to the present invention includes:

a base plate having a horizontal wall connected to a door lock body and a vertical wall which is substantially perpendicular to the horizontal wall;

a rotation lever rotatably supported to the vertical wall of the base plate;

an actuator housing secured to the vertical wall of the base plate;

a key lever rotatably supported to the actuator housing; and a connecting lever having a first end and a second end, the first end being coupled to the rotation lever after a rotation of the first end relative to the rotation lever, the second end being coupled to the key lever after a rotation of the second end relative to the key lever, the connecting lever being in parallel to and close to the vertical wall of the base plate.

Still other objects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The above and other objects, features, and advantages of the present invention will be more apparent and more readily appreciated from the following detailed description of preferred exemplary embodiments of the present Invention, taken in connection with the accompanying drawings, in which.

DESCRIPTION OF THE PREFERRED EMBODIMENTS

Figure 1:
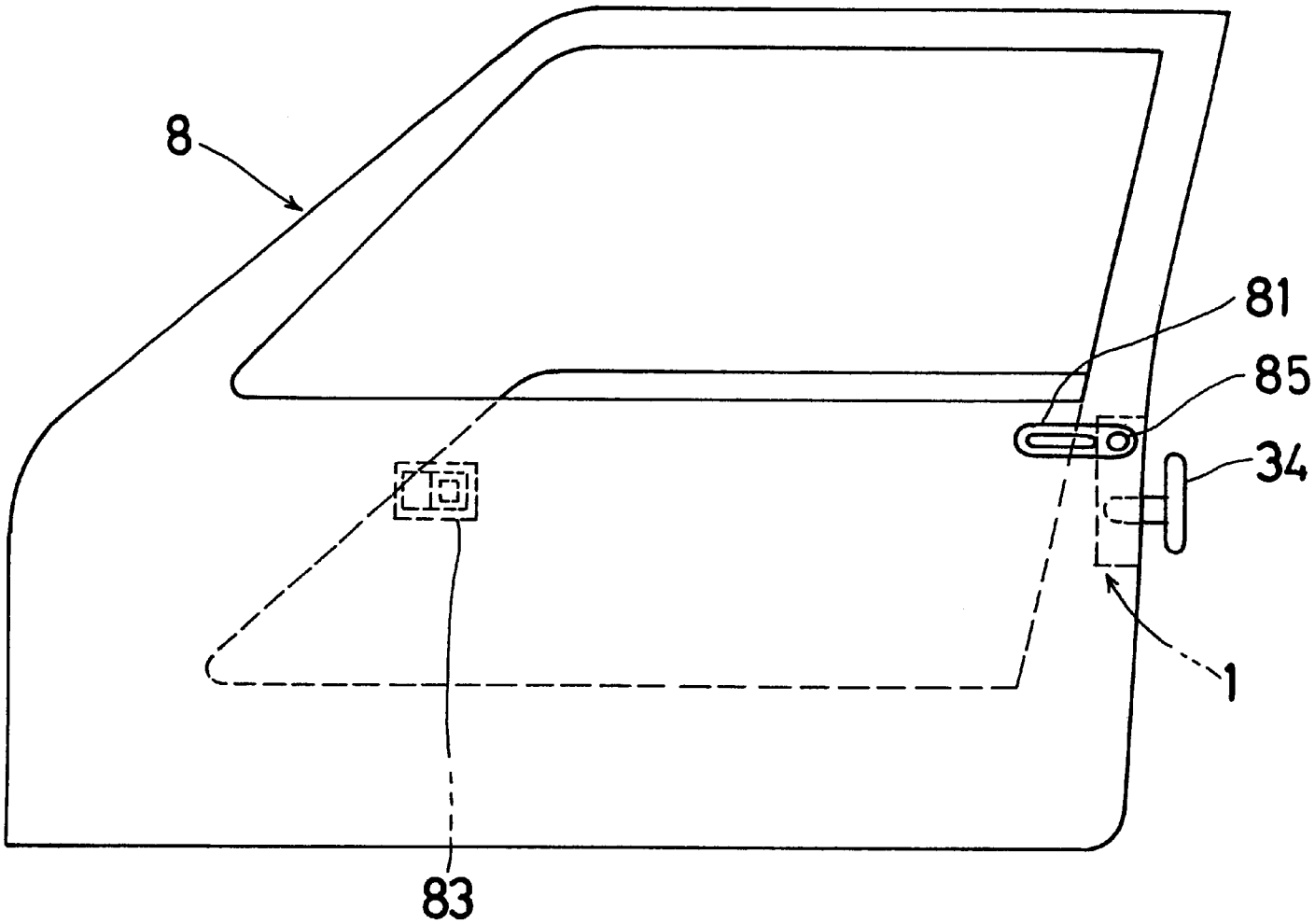
FIG. 1 illustrates a front view of a vehicle-door provided with a door lock device in accordance with an embodiment of the present invention.

Referring to the drawing figures, like reference numerals designate identical or corresponding elements throughout the several figures.

Figure 2:
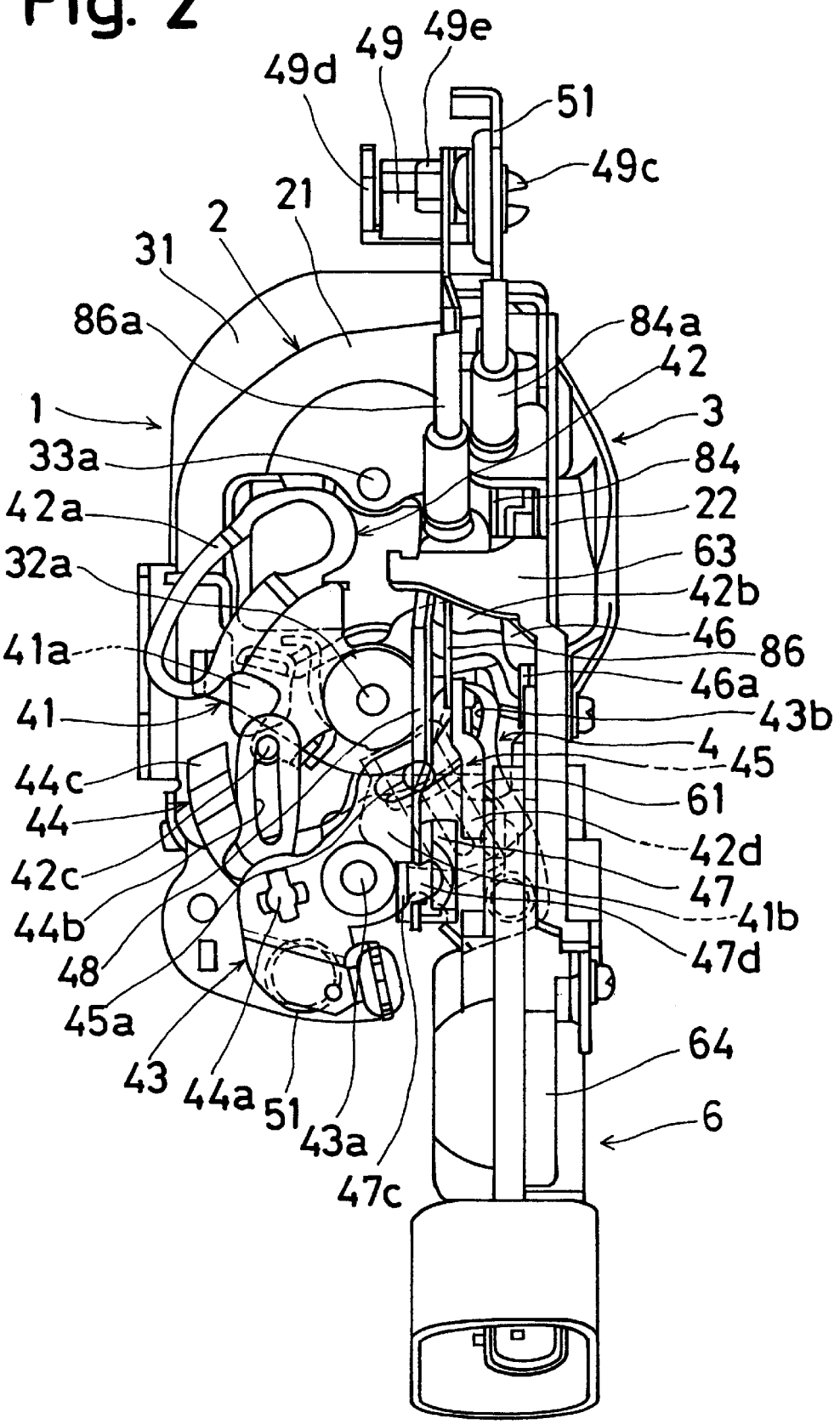
FIG. 2 illustrates a front view of a door lock device in accordance with an embodiment of the present invention.
Figure 3:
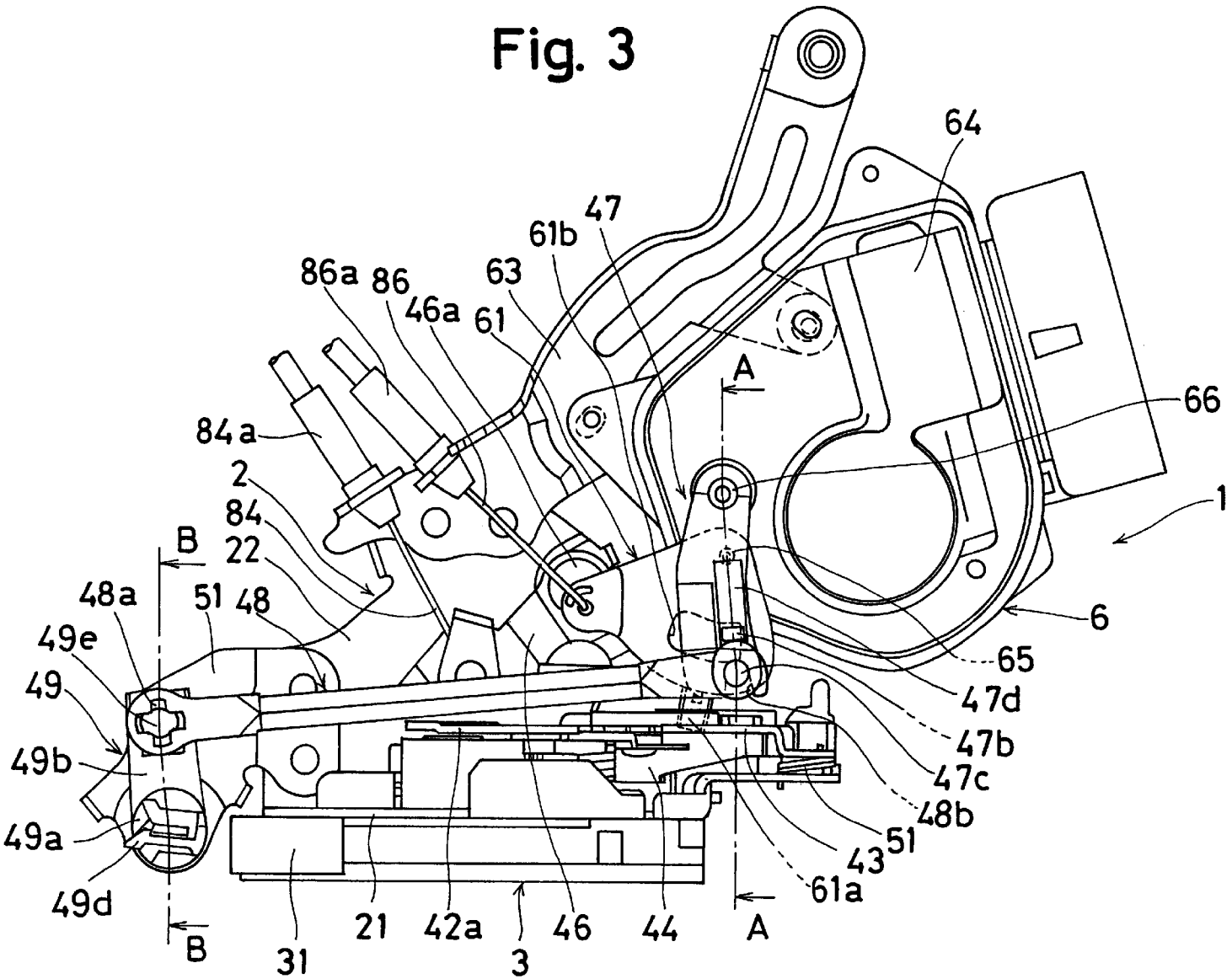
FIG. 3 illustrates a side view of the door lock device shown in FIG. 2.

Referring first to FIG. 1, a door lock device 1 is illustrated which is accommodated in a vehicle-door 8, and includes a base plate 2, a latch mechanism 3, a lever mechanism 4, and a locking actuator 6, as illustrated in FIGS. 2 and 3.

The base plate 2 is of a substantially L-shaped configuration and is configured to have a horizontal wall 21 and a vertical wall 22 which extends from the horizontal wall 21 in such a manner that when the base plate 2 is mounted in the vehicle-door 8, opposite surfaces are directed along a vehicle lateral in-and-out direction (horizontal direction in FIG. 2), and the extension direction of the vertical wall 22 starts from an inner space side of the horizontal wall 21.

Figure 4:
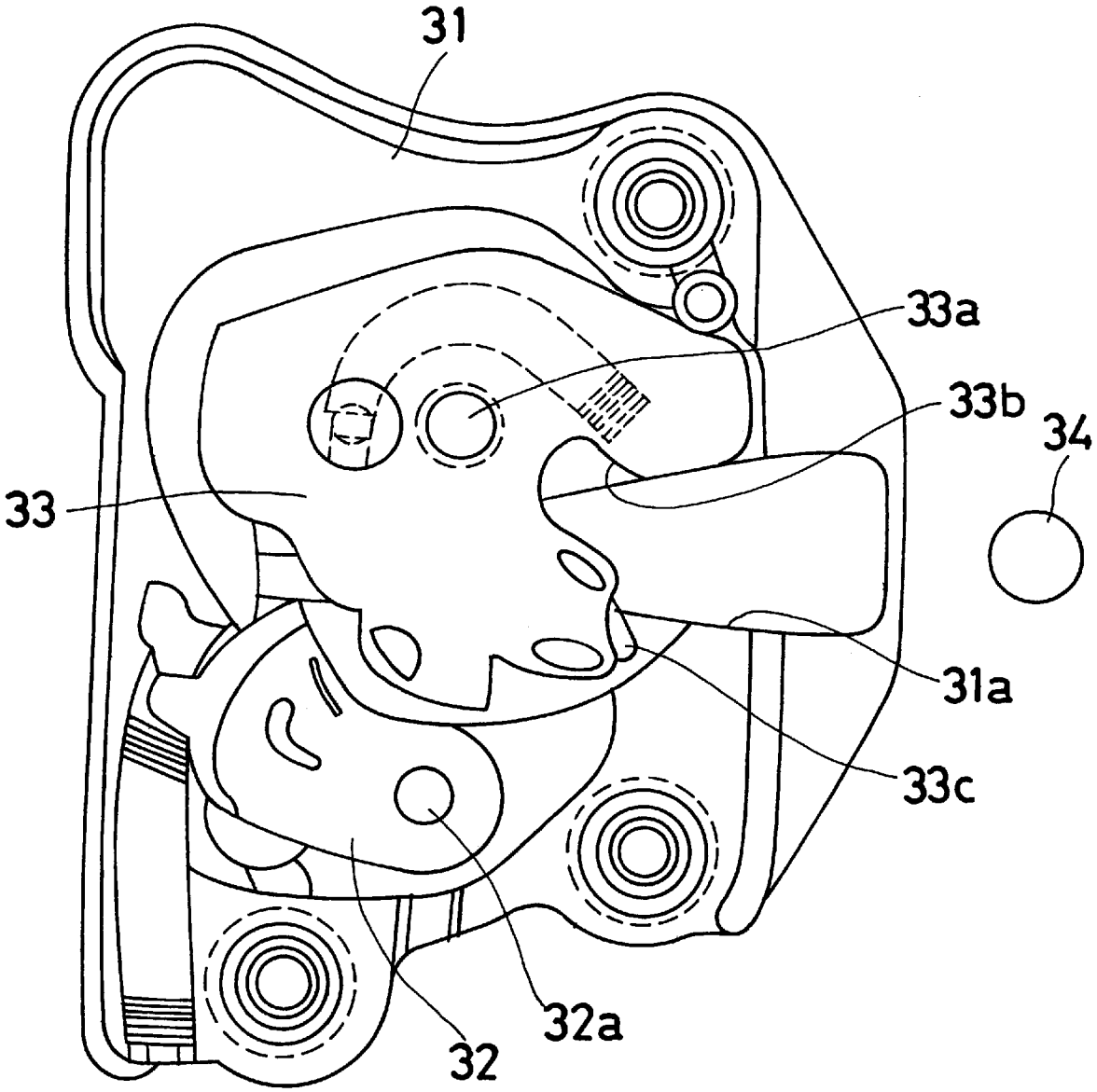
FIG. 4 illustrates a front view of a latch mechanism employed in the door lock device shown in FIG. 2.

As best illustrated in FIG. 4, the latch mechanism 3 includes a body 31, pawl 32, and a latch member 33. The body 31, which accommodates therein the pawl 32 and the latch member 33, is secured to a rear side of the horizontal wall 21 of the base plate 2. The body 31 is formed with a groove 31 a whose opening is directed toward an inner space of the vehicle body (not shown) so as to receive and remove a striker 34 when the vehicle-door 8 is brought into its closed and opened conditions, respectively. The pawl 32 and the latch member 33 are pivoted to the body 31 by a pin 32*a* and a pin 33*a*, respectively. The body 31 is provided at an outer surface thereof with a U-shaped groove 33*b* for receiving the striker 34 upon receipt thereof in the groove 31*a* and an engaging pawl 33*c* which is engaged by the pawl 32 upon rotation thereof. The pawl 32 and the latch member 33 which are of the respective foregoing arrangement retain the vehicle door 8 at its closed condition in such a manner that the engagement between the pawl 32 and the engaging pawl 33*c* of the latch member 33 restricts rotational movement of the latch member 33 while the striker 34 is received in the U-shaped groove 33*b* of the latch member 33. When the pawl 32 is rotated, the engaging pawl 33*c* of the latch 33 is moved to its released condition, allowing the vehicle-door 8 to be opened.

As shown in FIG. 2, the lever mechanism 4 includes, as its major elements, a lift lever 41, an open lever 42, a locking lever 43, a cancel lever 44, and a slide bush 45.

The lift lever 41 is placed on an outer surface of the horizontal wall 21 of the base plate 2 and is rotatably mounted on the pin 32*a* which supports the pawl 32 of the latch mechanism 3. The lift lever 41 has one arm portion 41*a* with a flange and is brought into rotation together with the pawl 32 when the flange is fitted in the pawl 32. Engaging flanges are provided to the one arm portion 41*a* and the other arm portion 41*b* of the lift lever 41, respectively.

Like the lift lever 41, the open lever 42 is placed on the outer surface of the horizontal wall 21 and is rotatable on the pin 32*a*. One arm portion 42*a* of the open lever 42 is connected via an open rod (not shown) to an outside handle 81 (FIG. 1) which is provided at an outer side of the vehicle-door 8. The open lever 42 is also formed with an extension arm 42*b* which is connected via a cable 84 and an inside lever 46 to an inside handle 83 (FIG. 1) that is provided at an inner side of the vehicle-door 8. It is to be noted that the inside lever 46 is rotatably supported on the vertical wall 22 by a pin 46*a* and the open lever 46 is provided with a pin portion 42*c*.

Figure 7:
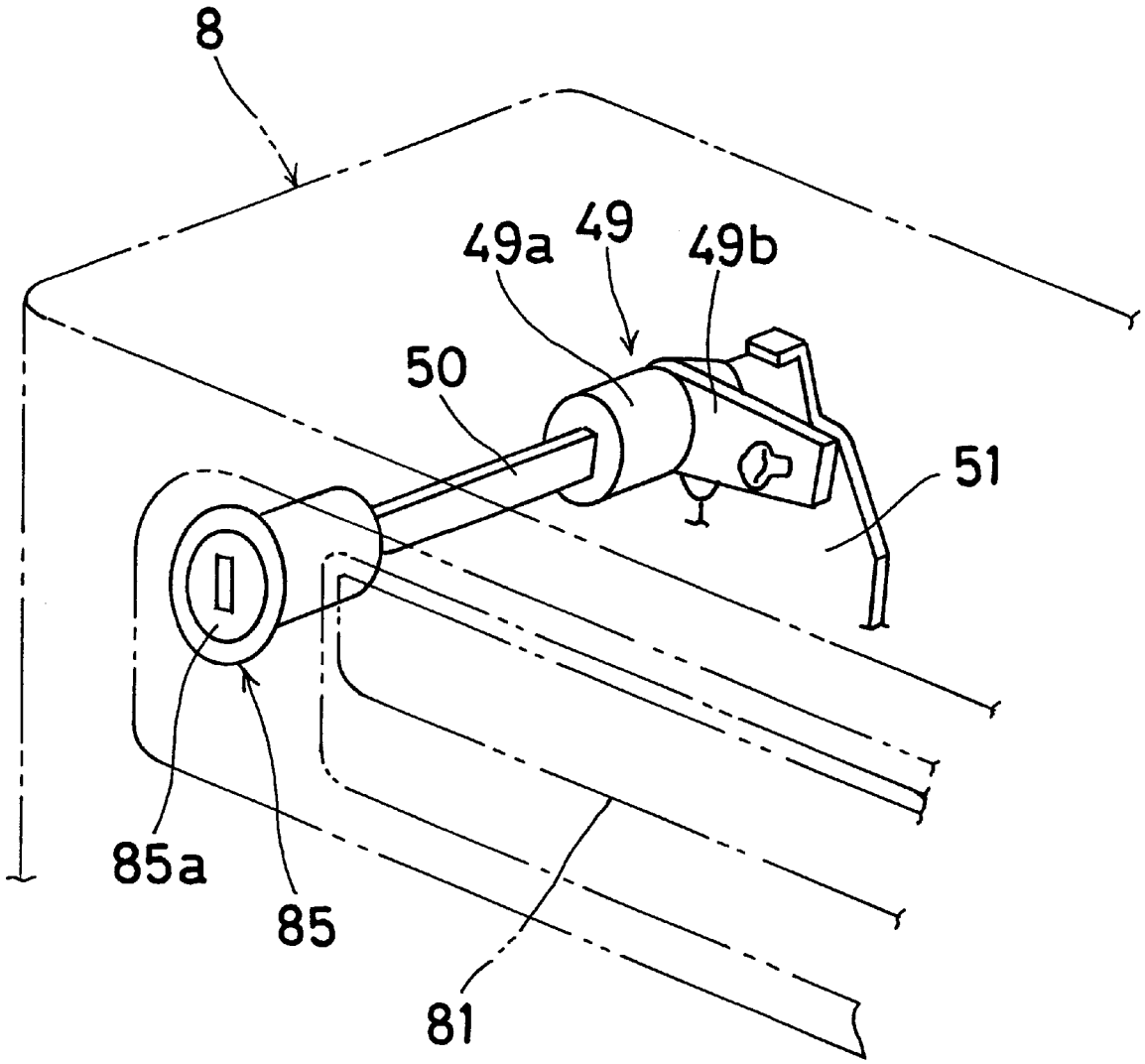
FIG. 7 illustrates a perspective view showing a connection in the vicinity of a rotation lever in the door lock device.
Figure 8:
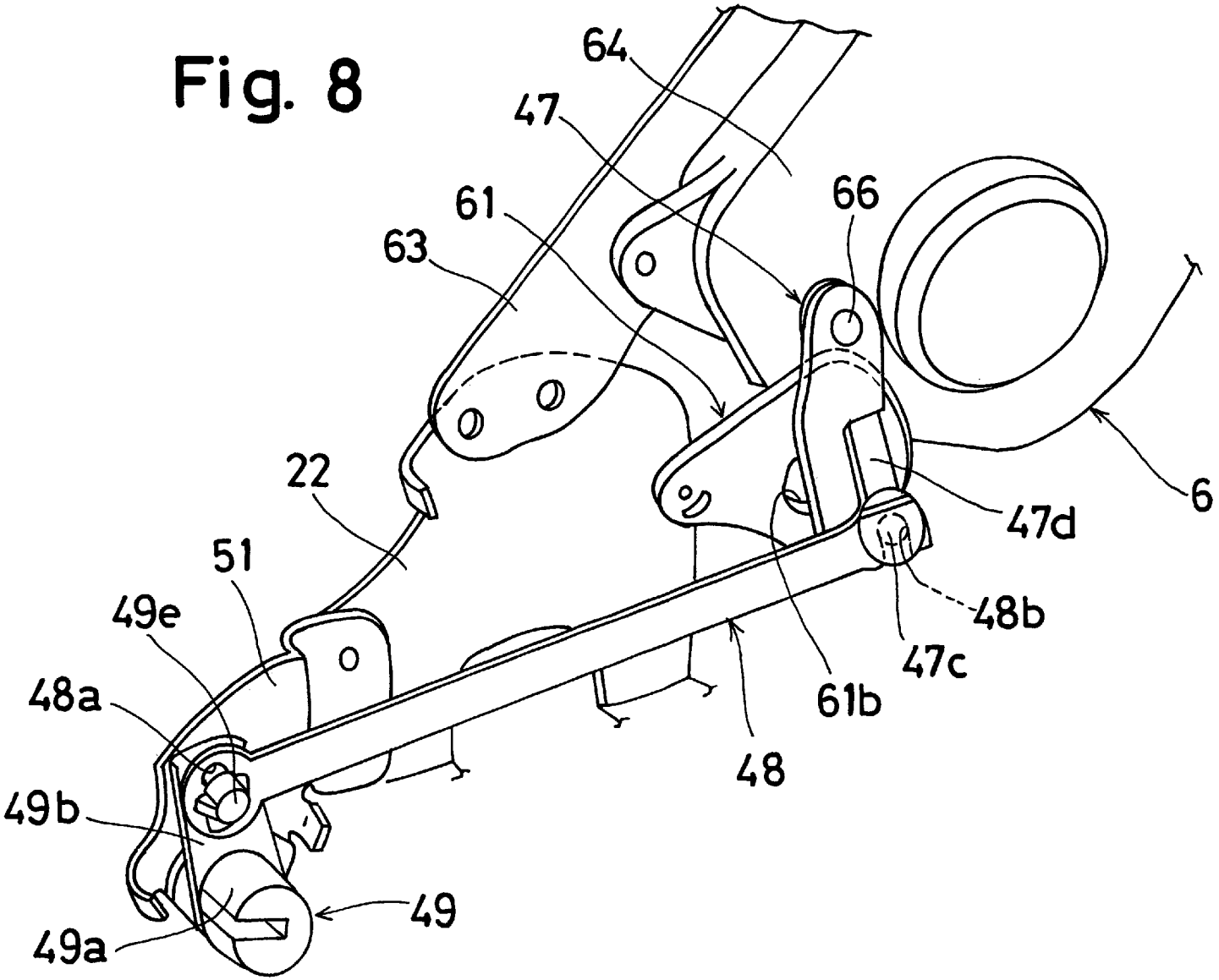
FIG. 8 illustrates a perspective view showing a connection mechanism with respect to a connecting lever, a rotation lever, and a key lever.
Figure 9:
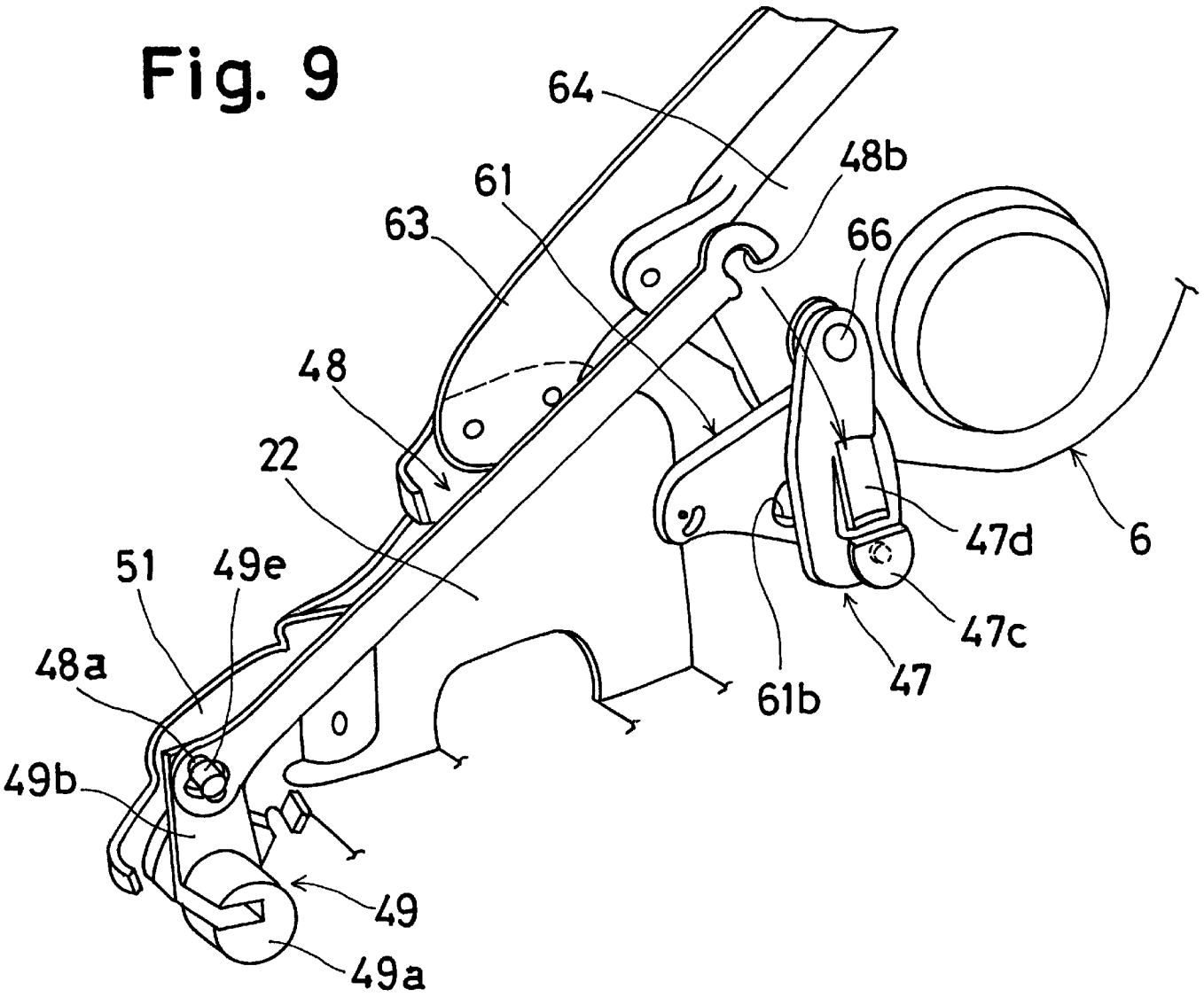
FIG. 9 illustrates how the connection mechanism is assembled.

The locking lever 43 is placed on the outer surface of the horizontal wall 21 so as to be rotatably supported thereon by a pin 43*a*. The locking lever 43 is connected to a lock knob (not shown) which is positioned at an inside of the vehicle-door 8 via both a cable 86 and an output lever 61 of a locking actuator 6, which will be described in greater detail below. The locking lever 43 is also connected to a key-cylinder mechanism 85 (FIG. 1) at an outside of the vehicle-door 8 via a key-lever 47, a connecting lever 48, a rotation lever 49, and a connecting rod 50 (FIG. 7). The locking lever 43 is provided with an arc-shaped slot 43*b* whose center coincides with the pin 32*a*.

The slide bush 45 is slidably mounted on the other arm portion 42*d* of the open lever 42. A pin portion 45*a* of the slide bush 45 is in sliding engagement with an arc-shaped slot 43*a* formed in the locking lever 43, and engaged and disengaged conditions of the slide bush 45 with the engaging flange of the other arm portion 41*b*, are established when the open lever 42 is rotated in opposite directions, respectively. Thus constructed, slide bush 45 is brought into sliding movement on the other arm portion 42*d* of the locking lever 42 when the locking lever 43 is rotated. This results in the locking lever 43 being transferred so as to be brought into engagement or disengagement with the engaging flange of the other portion 41*b* of the lift lever 41. Thus, a latched condition and an unlatched condition of the vehicle-door 8 are established. In order for each of the latched condition and the unlatched conditions of the vehicle-door 8 to remain unchanged, the locking lever 43 is under continuous biasing by a turnover spring 51 disposed between the locking lever 43 and the base plate 2.

The cancel lever 44 is rotatably supported by the locking lever 43 by means of a key-shaped pin portion 44*a* which is an integrated portion of the cancel lever 44. At a distal end of the cancel lever 44, there is formed a slot 44*a* with which one arm portion 42*a* of the open lever 42 is in sliding engagement. The distal end of the cancel lever 44 is also provided with an engaging projection 44*c* in parallel with the slot 44*a* so as to be engaged with the engaging flange of one arm portion 41*a* of the lift lever 41 when the cancel lever 43 is brought into a concurrent rotation with the lift lever 41 which is established by the pawl 32. The cancel lever 44 is pivotally movable relative to the locking lever 43 when the open lever 42 is rotated, so that the projection 44*c* of the cancel lever 44 takes positions to be able to engage or disengage with the engaging flange of one arm portion 41*a* of the lift lever 41. Thus, a latching operation or a keyless entry operation and a canceling operation to the latching operation are performed. This means that the door lock mechanism 1 has a keyless entry mechanism established by the cancel lever 44.

Figure 5:
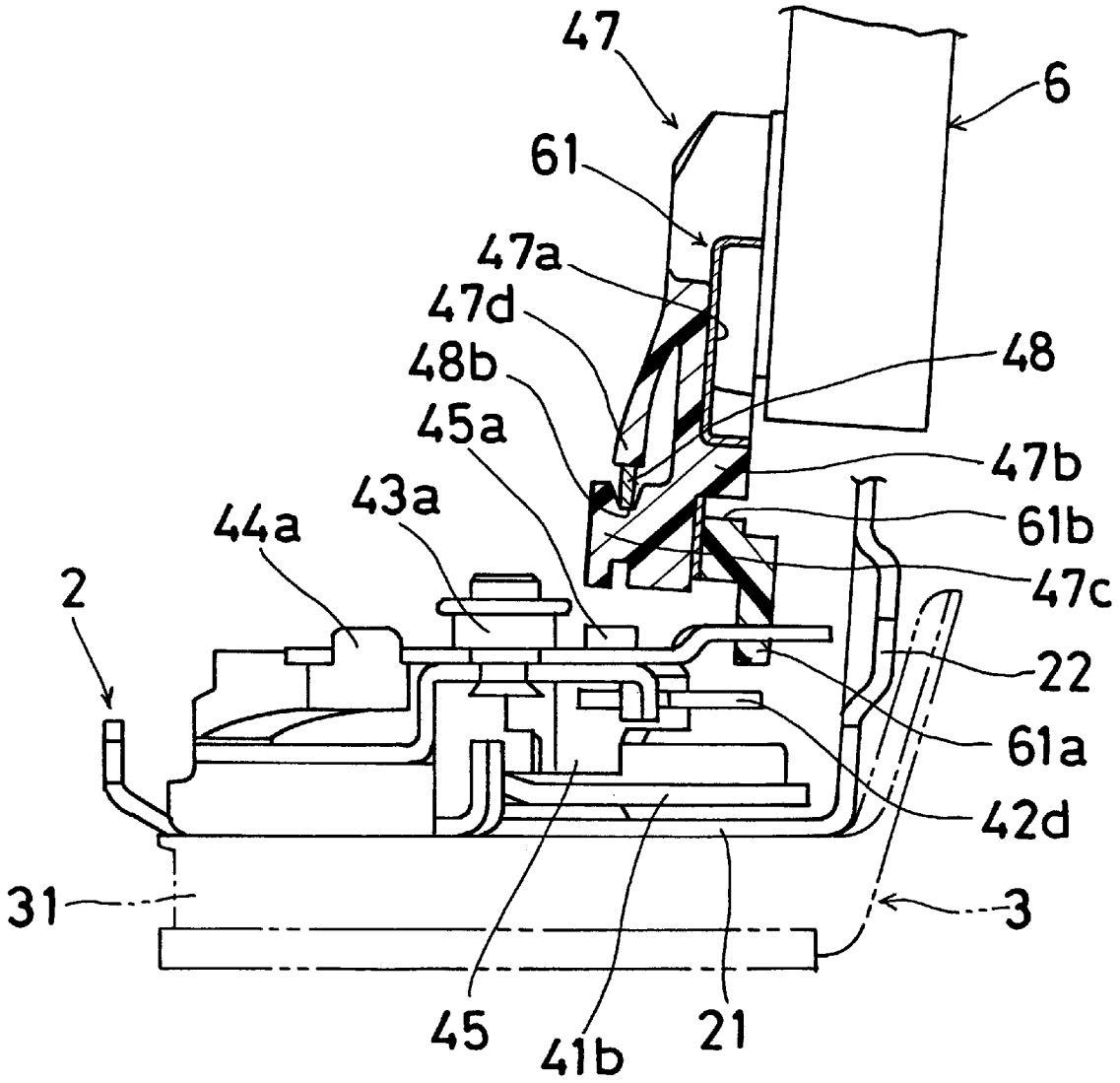
FIG. 5 illustrates a cross-sectional view taken along line A—A in FIG. 3.

The locking actuator 6 includes an electric motor (not shown) as a driving source which is accommodated in a housing 64 and is secured via a bracket 63 to the vertical wall 22. The bracket 63 also supports tubes 84*a* and 86*a* through which cables 84 and 86 pass, respectively. As shown in FIGS. 3 and 5, an output shaft 65 (FIG. 3) , which is coupled to the motor via a speed reduction gear train (not shown) so as to be rotated by the motor, extends outside the housing 64. A distal end of the output shaft 65 is fixed thereon with an output lever 61 so that a unitary rotation of the output shaft 65 and the output lever 61 is established. The output lever 61 is positioned so as to be perpendicular to the locking lever 43 and a lower end projection 61*a* of the output lever 61 is fitted in the locking lever 43. Thus, rotating the output lever 61 causes a rotational movement of the locking lever 43 which establishes the slide movement the slide bush 45.

Within the locking actuator 6, there is accommodated a key switch (not shown) whose detection shaft 66 (FIG. 3) extends outside the housing 64 and terminates in a distal end on which the key-lever 47 is fixed. The fixing of the key-lever 47 is made in an integral manner so as to establish a unitary rotation of the key-lever 47 and the detection shaft 66. The key-lever 47 and the output lever 61 are set to be rotated in parallel substantially to the vertical wall 22 of the base plate 2. A rear side of the key-lever 47 is provided with a concave portion 47*a* and the key-lever 47 is in an overlapped structure relative to the output lever 61 in such a manner that the output lever 61 is accommodated in the concave portion 47*a*. The output lever 61 is formed therein with an arc-shaped slot 61*b* whose center coincides with the rotation center of the key-lever 47 or a detecting shaft 62. The key-lever 47 is provided with a projection 47*b* which is fitted in the slot 61*b*. Such an arrangement is able to establish a so-called 'lost-motion function' wherein, despite rotational movement of the key-lever 47 which causes rotation of the output lever 61, the rotation of output lever 61 fails to be transmitted to the key-lever 47.

Figure 6:
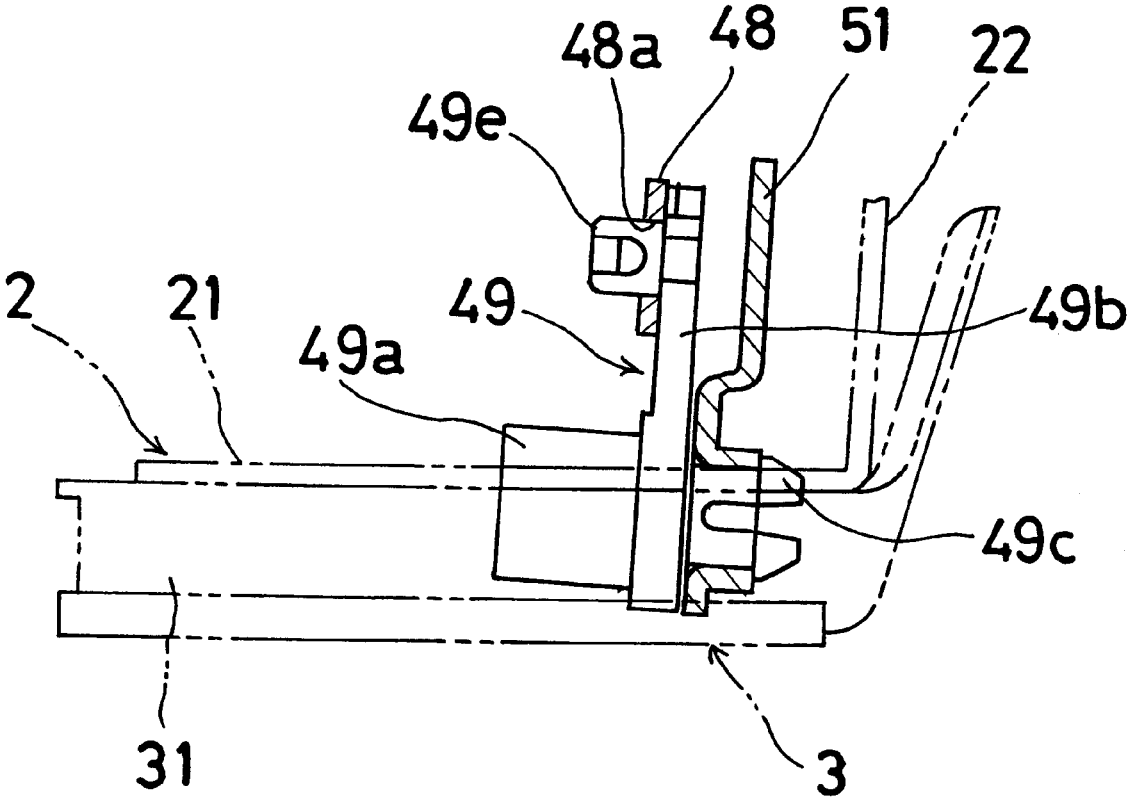
FIG. 6 illustrates a cross-sectional view taken along line B—B in FIG. 3.

As shown in FIGS. 3 and 6, the rotation lever 49 is rotatably supported on a bracket 51 which is secured to the vertical wall 22 of the base plate 2. The rotation lever 49 is in the form of an integral configuration which has a column portion 49*a* and an arm portion 49*b* extending therefrom. As can be best appreciated from the illustration in FIG. 6, the column portion 49*a* is provided integrally at its rear side with a snap pin portion 49*c* and is so arranged as to be in alignment with the key cylinder mechanism of the vehicle-door 8. The bracket 51 is formed therein with a cylindrical boss portion 51*a*. The rotation lever 49 is fitted in the boss portion 51*a* and a distal end of the rotation lever 49 is riveted to be engaged with a distal end of the boss portion 51*a*, thereby establishing a rotational support of the rotation lever 49 on the bracket 51. In addition, a fitting pawl 49*d* is formed integrally at an end portion of an outer surface of the column portion 49*a*.

The connecting rod 50 is coaxially disposed between the key cylinder mechanism and the rotation lever 49 and forms an angle of 90 degrees with respect to the vertical wall 22 of the bracket 51. One end of the connecting rod 50 is secured to the rotational output member 85*a* of the key cylinder mechanism 85 so as to be rotated together therewith and the other end is fitted in the hole 49*d* of the rotation lever 49 for unitary rotation therewith. Thus, rotating the rotational output member 85*a* of the key cylinder 85 establishing a unitary rotation of the rotation lever 49 therewith via the connecting rod 50.

As illustrated in FIGS. 5. 6, 8, and 9, the connecting lever 48 is so arranged as to be in parallel and close to the vertical wall 22 of the lease plate 2. The connecting lever 48 is provided at one end and the other end thereof with a key-shaped passing-hole 48*a* and a notch 48*b*, respectively. At a distal end of the arm portion 49*b* of the rotation lever 49, there is formed a key-shaped shaft portion 49*e*, and at an outer surface of the key lever 47, there is formed a shaft portion 47*c*. In addition, a slant flange portion 47*d* is formed so as to be close to the shaft portion 47*c*. The connecting lever 48 is connected to the shaft portion 47*c* of the key lever 47 by the following steps:

fitting the key-shaped shaft portion 49*e* of the rotation lever 49 into the key-shaped hole 48*a* after lining up the key-shaped shaft portion 49*e* and the key-shaped hole 48*a*; rotating the resultant connecting lever 48 about the key-shaped shaft portion 49*e*; and engaging the notch portion 49*e* with the shaft portion 47*c* of the key lever 47 after sliding on the slant flange portion 47*c* thereof.

After completion of such a movement of the connecting lever 48, the key-shaped shaft portion 48*b* and the key-shaped hole 48*a* do not line up, thereby preventing extraction of the former from the latter. In addition, a distal end of the slant flange 47*d* is brought into engagement with a distal end of the notch 48*b*, thereby ensuring a coupling between the shaft portion 47*c* and the notch 48*b*. Thus, the rotation lever 49 and the key lever 47 are brought into connection via the connecting lever 48, thereby establishing rotation of the key lever 47 whenever the connecting lever 48 is urged to be in linear movement by a rotation of the rotation lever 49.

In operation, under the unlocked condition shown in FIG. 2, when the outside handle 6 is operated, the resultant movement thereof is transmitted via the open rod to the open lever 42, thereby rotating the open lever 42 through an angle from its original position depicted in FIG. 2 in the counter-clockwise direction in FIG. 2. Such a rotation of the open lever 42 causes engagement of the engaging projection of the slide bush 45 and the engaging flange of the other arm portion 41*b* of the lift lever 41, which rotates the lift lever 41 in the counter-clockwise direction. Thus, the pawl 32 is rotated and the vehicle-door 8 becomes ready to be opened. Also, upon manipulation of the inside handle 5, the open lever 42, which is connected thereto via the cable 84 and the inside lever 46, is rotated through an angle from its original position shown in FIG. 2. This rotational movement of the open lever 42 causes engagement of the engaging projection of the slide bush 45 with the engaging flange of the other arm portion 41*b* of the lift lever 41 in the counter-clockwise direction. Thus, the pawl 32 is rotated and the vehicle-door 8 becomes ready to be opened.

In FIG. 2, if the lock knob is manipulated, the cable 84 connected thereto rotates the output lever 61. At this time, due to the foregoing 'lost motion function', the key lever 47 fails to rotate. Such a rotational movement of the output lever 61 is transmitted via its lower projection 61*a* to the locking lever 43 which causes a rotation thereof, thereby moving or sliding the slide bush 45 relative to the open lever 42. Thus, the engaging projection of the slide bush 45 is transferred to a position at which it is out of engagement with the other arm portion 41*b* of the lift lever 41, resulting in that a null operation is made even though the open lever 42 or the lift lever 41 is manipulated. This means that even though the vehicle-door 8 is in the unlocked condition the vehicle-door 8 is, in effect, in a locked condition.

In FIG. 2, manipulating or operating the key cylinder mechanism 85 causes rotation of the rotation lever 49 which is connected thereto via the connecting rod 50, causing the key lever 47 also to be rotated, which is connected to the rotation lever 49 via the connecting rod 48. At this time, the foregoing so-called 'lost motion function' transmits the rotational movement of the key lever 47 to the output lever 61, thereby rotating the output lever 61. The resultant rotational movement of the output lever 61 is, then, transmitted via its lower projection 61*a* to the locking lever 43 which rotates the locking lever 43, causing the slide bush 45 to slide relative to the open lever 42. Thus, the engaging projection of the slide bush 45 is transferred to a position at which it is out of engagement with the other arm portion 41*b* of the lift lever 41, resulting in that a null operation is made even though the open lever 42 or the lift lever 41 is manipulated. This means that even though the vehicle-door 8 is in the unlocked condition, the vehicle door 8 is effectively in a locked condition.

In accordance with the present invention, rotating the connecting lever can realize that one end and the other end thereof can be coupled to the key lever and the rotation lever, respectively, thereby ensuring that the resultant couplings are reliable without fear of disengagement or extraction and the number of related parts. This brings a simplified connection between the rotation lever and the key lever.

The invention has thus been shown and description with reference to a specific embodiment, however, it should be understood that the invention is in no way limited to the details of the illustrates structures but changes and modifications may be made without departing from the scope of the appended claims.

What is claimed is:

1. A door lock device for automotive vehicles comprising:

a base plate having a horizontal wall connected to a door lock body and a vertical wall which is substantially perpendicular to the horizontal wall;

a rotation lever pivotally attached to the vertical wall of the base plate;

an actuator housing secured to the vertical wall of the base plate;

a key lever pivotally attached to the actuator housing and connected to a key cylinder;

a connecting lever coupled to the rotation lever and the key lever, one of the connecting lever and the rotation lever being provided with a shaft portion and the other of the connecting lever and the rotation lever being provided with a hole; and means for allowing the shaft portion to be fitted into the hole when the connecting lever is parallel to the vertical wall and in a first rotational position relative to the rotation lever and for preventing the shaft portion from being removed from the hole when the connecting lever is parallel to the vertical wall and in a second rotational position relative to the rotation lever that is different from the first rotational position to couple the connecting lever to the rotation lever when the connecting lever is in the second rotational position relative to the rotation lever.

2. The door lock device, as set forth in claim 1, wherein the actuator housing forms part of an actuator, the actuator including an output lever, and including means coupling the key lever and the output lever of the actuator to each other so that when the key lever is rotated in one direction or an opposite direction the key lever rotates together with the output lever and when the output lever is rotated in one direction or an opposite direction the output lever and the key lever rotate relative to one another.

3. The door lock device as set forth in claim 1, wherein the key lever includes a flange portion and a shaft element positioned beneath the flange portion, one end of the connecting lever engaging the shaft element and being prevented from rotating from the second position towards the first position by the flange portion.

4. The door lock device as set forth in claim 3, wherein the flange portion is formed integrally with the key lever.

5. The door lock device as set forth in claim 1, wherein said means includes said shaft portion being key-shaped and the hole being key-shaped.

6. The door lock device as set forth in claim 5, wherein the key-shaped shaft portion is formed on the rotation lever and the key-shaped hole is formed in an end portion of the connecting lever.

7. The door lock device as set forth in claim 1, wherein the shaft portion is formed on the rotation lever and the hole is formed in an end portion of the connecting lever.

8. The door lock device as set forth in claim 1, wherein the rotation lever is linked to the key cylinder by way of a connecting rod, the rotation lever being rotatable about a rotation axis of the key cylinder.

9. A door lock device for automotive vehicles comprising:

a base plate having a horizontal wall connected to a door lock body and a vertical wall which is substantially perpendicular to the horizontal wall;

a rotation lever pivotally attached to the vertical wall of the base plate;

an actuator housing secured to the vertical wall of the base plate; and a key lever pivotally attached to the actuator housing and connected to a key cylinder;

a connecting lever coupled to the rotation lever and the key lever, one of the connecting lever and the rotation lever being provided with a shaft portion and the other of the connecting lever and the rotation lever being provided with a hole, the shaft portion being positioned in the hole and having a plurality of outwardly extending elements that engage a surrounding portion of the hole to couple the connecting lever to the rotation lever.

10. The door lock device as set forth in claim 9, wherein the key lever includes a flange portion and a shaft element positioned beneath the flange portion, one end of the connecting lever being coupled to the flange portion, the flange portion preventing upward movement of the one end of the connecting lever.

11. The door lock device as set forth in claim 10, wherein the flange portion is formed integrally with the key lever.

12. The door lock device as set forth in claim 9, wherein said hole is a key-shaped hole.

13. The door lock device as set forth in claim 9, wherein the shaft portion is formed on the rotation lever and the hole is formed in an end portion of the connecting lever.

14. A door lock device for automotive vehicles comprising:

a base plate having a horizontal wall connected to a door lock body and a vertical wall which is substantially perpendicular to the horizontal wall;

a rotation lever pivotally attached to the vertical wall of the base plate;

an actuator housing secured to the vertical wall of the base plate; and a key lever pivotally attached to the actuator housing and connected to a key cylinder;

a connecting lever coupled to the key lever and the rotation lever, one of the connecting lever and the key lever being provided with a shaft element and the other of the connecting lever and the key lever being provided with a notch that is open along one side to permit the connecting lever to be moved from a first rotational position relative to the key lever in which the shaft element is out of engagement with the notch to a second rotational position relative to the key lever in which the shaft element and the notch engage one another.

15. The door lock device as set forth in claim 14, wherein the shaft element is formed on the key lever, the key lever including a flange portion positioned beneath the flange portion for preventing the connecting lever positioned in the second position from being rotated towards the first position.

16. The door lock device as set forth in claim 15, wherein the flange portion is formed integrally with the key lever.

17. The door lock device as set forth in claim 14, wherein the shaft element is provided on the key lever and the notch is provided on one end of the connecting lever.

18. The door lock device as set forth in claim 14, wherein the end of the connecting lever opposite said one end is provided with a key-shaped hole, and including a key-shaped shaft portion provided on the rotation lever, the key-shaped shaft portion being positioned in the key-shaped hole to couple the connecting lever to the rotation lever.

* * * * *